US008696251B2

(12) United States Patent
Potvin et al.

(10) Patent No.: US 8,696,251 B2
(45) Date of Patent: Apr. 15, 2014

(54) MESH SYSTEM

(75) Inventors: Yves Potvin, Hillarys (AU); Victor Stampton, Queensland (AU)

(73) Assignee: The University of Western Australia (AU)

( * ) Notice: Subject to any disclaimer, the term of this patent is extended or adjusted under 35 U.S.C. 154(b) by 143 days.

(21) Appl. No.: 12/668,159

(22) PCT Filed: Jul. 9, 2008

(86) PCT No.: PCT/AU2008/001009

§ 371 (c)(1),
(2), (4) Date: Jun. 15, 2010

(87) PCT Pub. No.: WO2009/006692

PCT Pub. Date: Jan. 15, 2009

(65) Prior Publication Data

US 2011/0044770 A1 Feb. 24, 2011

(30) Foreign Application Priority Data

Jul. 9, 2007 (AU) ..... 2007903702
Jul. 9, 2007 (AU) ..... 2007903703

(51) Int. Cl.
*E02D 17/20* (2006.01)

(52) U.S. Cl.
USPC ..... 405/302.7; 405/272; 405/288; 405/302.3

(58) Field of Classification Search
USPC ..... 405/258.1, 272, 288, 302.2, 303.3, 405/302.4, 302.7; 256/12.5, 23, 45
See application file for complete search history.

(56) References Cited

U.S. PATENT DOCUMENTS

| | | | | |
|---|---|---|---|---|
| 349,059 | A * | 9/1886 | Scarles | 52/687 |
| 5,972,245 | A | 1/1898 | Phillips | |
| 4,632,605 | A | 12/1986 | Tucker | |
| 5,096,335 | A | 3/1992 | Anderson et al. | |
| 5,395,105 | A * | 3/1995 | Thommen, Jr. | 256/12.5 |
| 5,401,120 | A | 3/1995 | Hussey et al. | |
| 5,462,391 | A * | 10/1995 | Castle et al. | 405/302.2 |
| 6,981,559 | B2 | 1/2006 | Rubie et al. | |
| 2005/0055953 | A1 | 3/2005 | Sacks et al. | |
| 2007/0131917 | A1 * | 6/2007 | Wartmann | 256/12.5 |

FOREIGN PATENT DOCUMENTS

| | | | |
|---|---|---|---|
| GB | 2150950 | * | 7/1985 |
| GB | 2364332 | | 1/2002 |
| WO | WO 2009/006692 | | 1/2009 |

OTHER PUBLICATIONS

Ortlepp, "Considerations in the Design of Support for Deep Hard-Rock Tunnels", International Society for Rock Mechanics, Apr. 10-15, 1983, D179-D187.

Stacy, T.R. et al., "Tunnel Surface Support—Capacities of Various Types of Wire Mesh and Shotcrete under dynamic loading", Journal of the South African Institute of Mining and Metallurgy, Oct. 2001, 337-342.

* cited by examiner

*Primary Examiner* — Sean Andrish
(74) *Attorney, Agent, or Firm* — Baker & Hostetler LLP

(57) ABSTRACT

There is provided a mesh system (2) comprising a mesh sheet (4) and a reinforcing member in the form of a cable (6) coupled to one side of the sheet (4). The cable (6) is coupled to the mesh by wire ties (7). Two lengths (6*a*) and (6*b*) of the cable (6) may overlap or be disposed in a mutually adjacent manner. The lengths (6*a*) and (6*b*) may be coupled together by U-bolts or crimped bands (9), which may also engage the underlying sheet (4).

25 Claims, 12 Drawing Sheets

MESH SYSTEM

CROSS-REFERENCE TO RELATED APPLICATIONS

This application is the National Stage of International Application No. PCT/AU2008/001009, filed Jul. 9, 2008, which claims the benefit of Australian Application No. 2007903702, filed Jul. 9, 2007, and Australian Application No. 2007903703, filed Jul. 9, 2007, the disclosures of which are incorporated herein by reference in their entirety.

FIELD OF THE INVENTION

The present invention relates to a mesh system, particularly, although not solely, for supporting or stabilizing a surface of a body of material such as rock.

BACKGROUND OF THE INVENTION

It is common practice in mining or civil construction to support the surface of an excavated tunnel or channel to protect workers and equipment and plant from rock bursts and rock falls. Various methods of providing such support include: spraying shotcrete to the surface, the use of rock bolts, and fixing wire mesh to the surface using rock bolts.

Another method known to be practiced, in particular in South Africa, is cable lacing where initially wire mesh is fixed to the surface, followed by one or more lengths of cable being laced across the mesh where the cables are being passed through hook or eye bolts fixed to the rock surface.

It will be clearly understood that, although prior art use and publications are referred to herein, this reference does not constitute an admission that any of these form a part of the common general knowledge in the art, in Australia or in any other country.

SUMMARY OF THE INVENTION

In the statement of invention and description of the invention which follow, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

According to a first aspect of the present invention there is a provided a mesh system comprising:

a mesh sheet; and, at least one reinforcing member disposed on at least one side of and coupled to the mesh sheet.

In one embodiment of the mesh system the at least one reinforcing member extends across said at least one side of the said mesh.

In a further embodiment, the mesh sheet is a ground support mesh.

The mesh sheet may comprise a group of first mesh elements and a group of second mesh elements wherein the group of first mesh elements interlace with the group of second mesh elements. The group of first mesh elements may extend substantially parallel to a first side of the mesh sheet, and the group of second mesh elements extend substantially parallel to a second side of the mesh sheet.

In one embodiment at least a sub-group of the first elements is formed of a length greater than a length of the first side of the mesh sheet. In a further embodiment at least a sub-group of the second elements is formed of a length greater than a length of the second side of the mesh sheet.

The mesh sheet may, in another embodiment, comprise a group of first mesh elements and a group of second mesh elements wherein the group of first mesh elements interlace with the group of second mesh elements and wherein at least one of the first mesh elements is formed with a first length having one or more bends.

The at least one of the second mesh elements may be formed with a second length having one or more bends. Further, a region of the mesh sheet comprises interlaced first and second lengths of the first and second mesh elements. In a further embodiment, the region of the mesh sheet is substantially centralised within the mesh sheet.

According to a second aspect of the present invention, there is provided a method of supporting a surface of a body of material, said method comprising the steps of:

providing a plurality of mesh systems in accordance with any of the embodiments of the first aspect of the present invention; and, securing each mesh system to the surface by one or more fasteners that extend into the body of material and engage the reinforcing member of a respective mesh sheet.

The method may further comprise the step of:

marking each mesh sheet with the positions where said fasteners are to be located.

According to a third aspect of the present invention, there is provided a method of supporting a rock face comprising:

providing a plurality of mesh systems in accordance with any one of claims 1 to 10;

operating a dual arm machine to hold and manipulate each mesh sheet with a first arm of the machine and securing the mesh sheet held in the first arm to the rock face by fasteners driven into the rock face with a second arm of the machine.

The method may further comprise the step of:

securing the mesh sheets in a pattern wherein at least two of the mesh sheets partially overlap each other.

The securing comprises fastening a reinforcing member of one mesh sheet into the rock face at a location where the reinforcing member overlies an adjacent mesh sheet.

Further, the securing may also comprise operating the second arm to initially pin each mesh sheet to the rock face and subsequently operating the dual arm machine to apply one or more rock bolts to fasten the reinforcing members to the rock face.

BRIEF DESCRIPTION OF THE DRAWINGS

Embodiments of the present invention will now be described, by way of example only, with reference to the accompanying drawings, in which.

DETAILED DESCRIPTION OF EMBODIMENTS OF THE INVENTION

Figure 1:
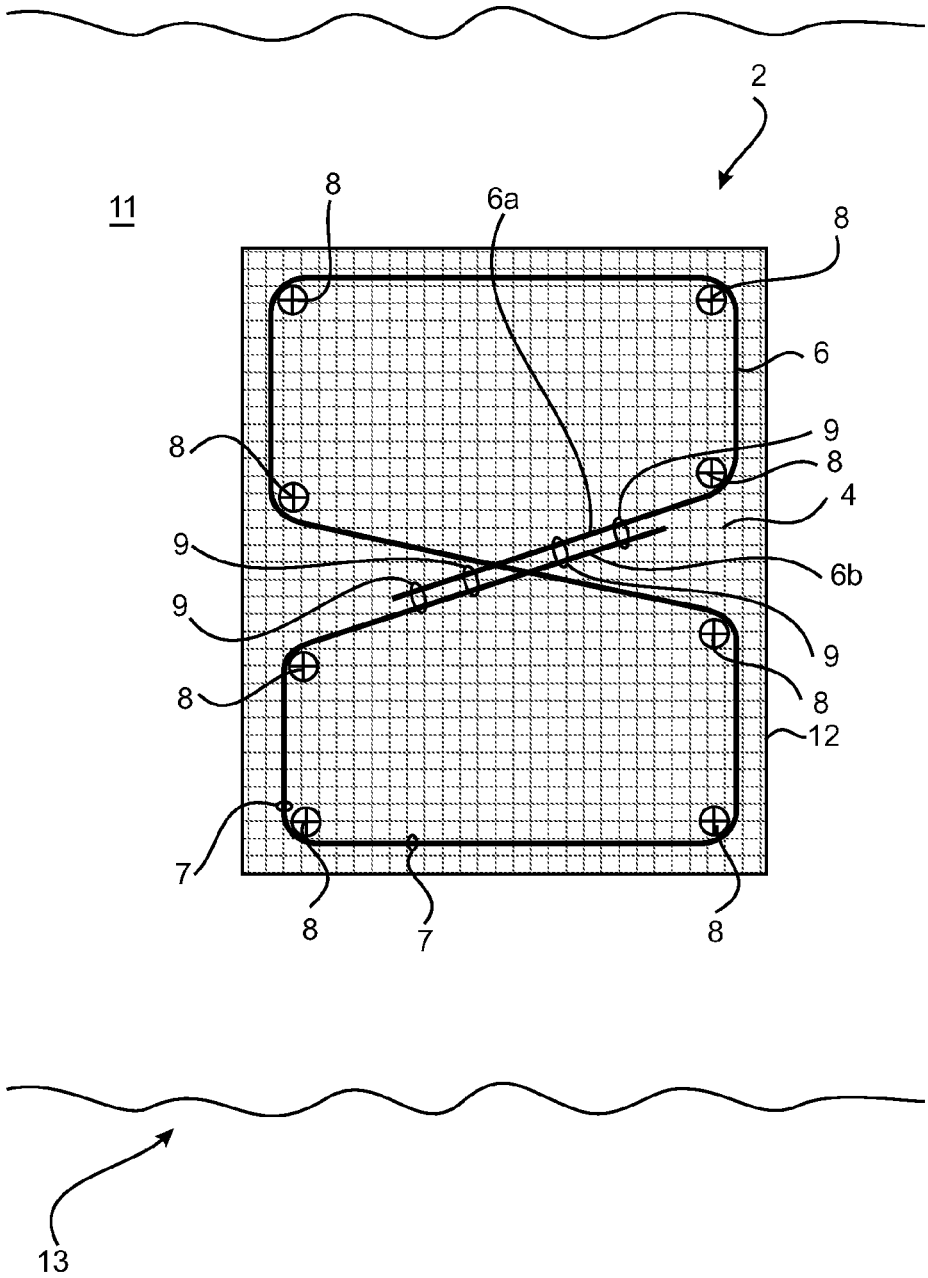
FIG. 1 shows one embodiment in accordance with the present invention.

FIG. 1 illustrates a mesh system 2 (hereinafter referred to as "mesh 2") in accordance with an embodiment of the present invention. The mesh 2 comprises a mesh sheet 4 (hereinafter referred to as "sheet 4") and a reinforcing member in the form of a cable 6 coupled to one side of the sheet 4. The cable 6 is coupled to the mesh by wire ties 7. Two lengths 6*a* and 6*b* of the cable 6 may overlap or be disposed in a mutually adjacent manner. The lengths 6*a* and 6*b* may be coupled together by U-bolts or crimped bands 9, which may also engage the underlying sheet 4. It may be appreciated that the wire ties 7 and/or U-blots, or crimped bands 9, may be secured temporarily or permanently. Swaging may also be used to couple lengths 6*a* and 6*b* of cable 6 together. As the reinforcing member (i.e. cable 6) is coupled to the mesh sheet 4, together they form a unitary panel, which as explained later below can be held and manipulated by an operator of a jumbo.

The cable 6 extends generally across its corresponding sheet 4. While the cable 6 is shown in FIG. 1 as running in a "FIG. 8" like configuration, as explained and illustrated below, many different configurations are possible. Also, while a single cable 6 is shown, different embodiments of the mesh 2 may comprise more than one cable 6 (i.e., two or more reinforcing members). The cable 6 is typically a multi-wire strand cable having sufficiently high tensile strength to provide reinforcing support to each sheet 4 and is sufficiently pliable to be assembled in configurations having one or more bends as shown; for example, in each of the embodiments presented in FIGS. 1 to 7. Further, the reinforcing member or cable may be formed from a lighter stronger material such as Kevlar® (i.e., poly-paraphenylene terephthalamide) or any other reinforcing material. The cable 6 may be formed of a hybrid of composite (polymer) and metallic materials depending on the strength and weight characteristics required.

As explained in greater detail below, the mesh 2 is attached to a surface 11 of a structure 13, such as a surface of a tunnel, by the use of mechanical fasteners 8, such as rock bolts, with the cables being clamped against the surface 11. Further, each mesh 2 is designed to be handled and installed by a single operator using a single drilling machine, such as a jumbo. The purpose of the cable 6 is to provide reinforcing to the sheet 4 to reduce the consequence of a rock burst or rock fall from breaking through the sheet 4, which can cause injury or death to workers and damage to equipment; that is, the cable provides additional structural capacity to the sheet 4.

Figure 2:
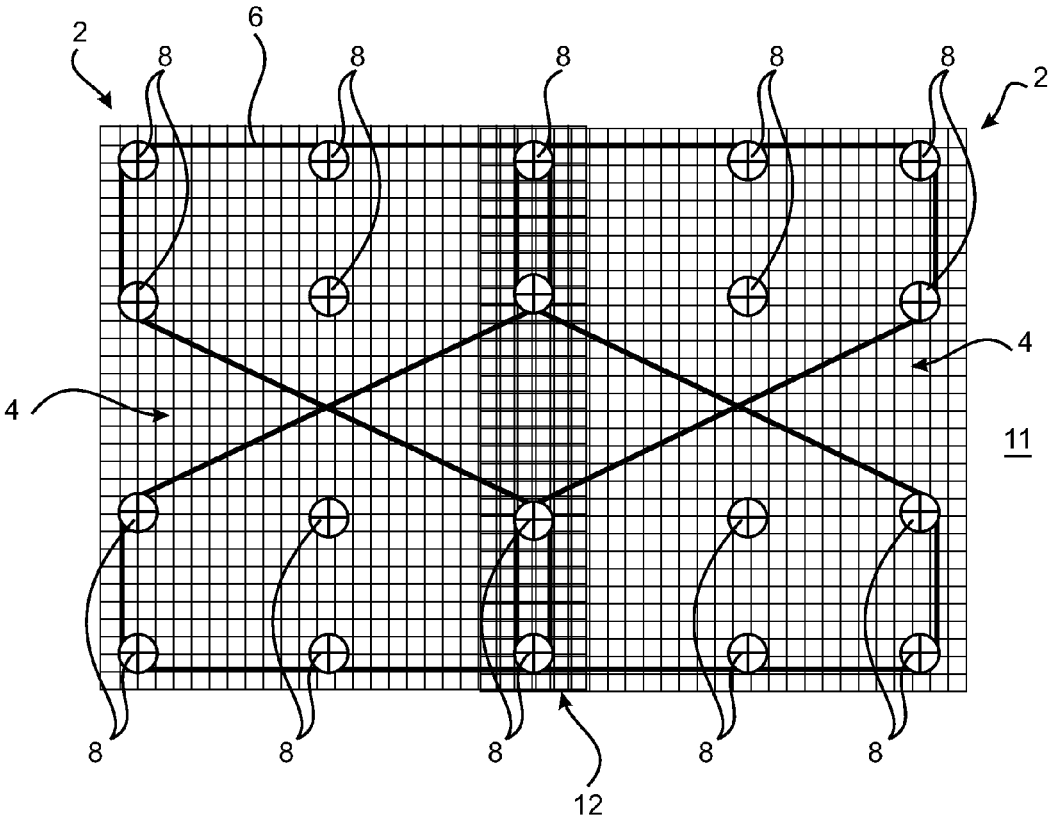
FIG. 2 shows a further embodiment in accordance with the present invention.

FIG. 2 illustrates two meshes 2 disposed one above the other and fixed to the surface of a tunnel excavated in a body of rock by a plurality of fasteners 8. The meshes are laid or fixed to the surface 11 in an overlapping manner so that a lower edge of an upper sheet 4 overlies an upper edge of a lower mesh 2. The overlap may be in the order of 2 to 3 rows of cells or squares in the sheets 4. It will be appreciated however that any number of rows of cells may be required to establish an overlap depending on the situation.

A flange or other fixing mechanism (such as 'face-plates' as known in the mining industry) is retained by the fastener 8 adjacent the surface 11 of the structure 13 for securing the mesh 2 and in particular the reinforcing member 6 to the surface 11. If required, additional fasteners 8 with flanges or washers may be used to clamp the mesh portion only against the surface 11. The body of material may be any formed or naturally occurring material such as rock, concrete or ground debris.

The particular configuration of fastener 8 may vary from application to application and may be dependant on the configuration of the cable 6. For example, FIG. 2 and FIG. 3 both show sheets 4 having a plurality of fasteners 8 spaced about both sheets 4 to engage or clamp the cable 6 in the configurations shown. Four fasteners 8 are positioned about the region where the sheets 4 overlap. At the overlapping region 12, the reinforcing members 6 of the sheets overlap mesh sheets 4.

Figure 3:
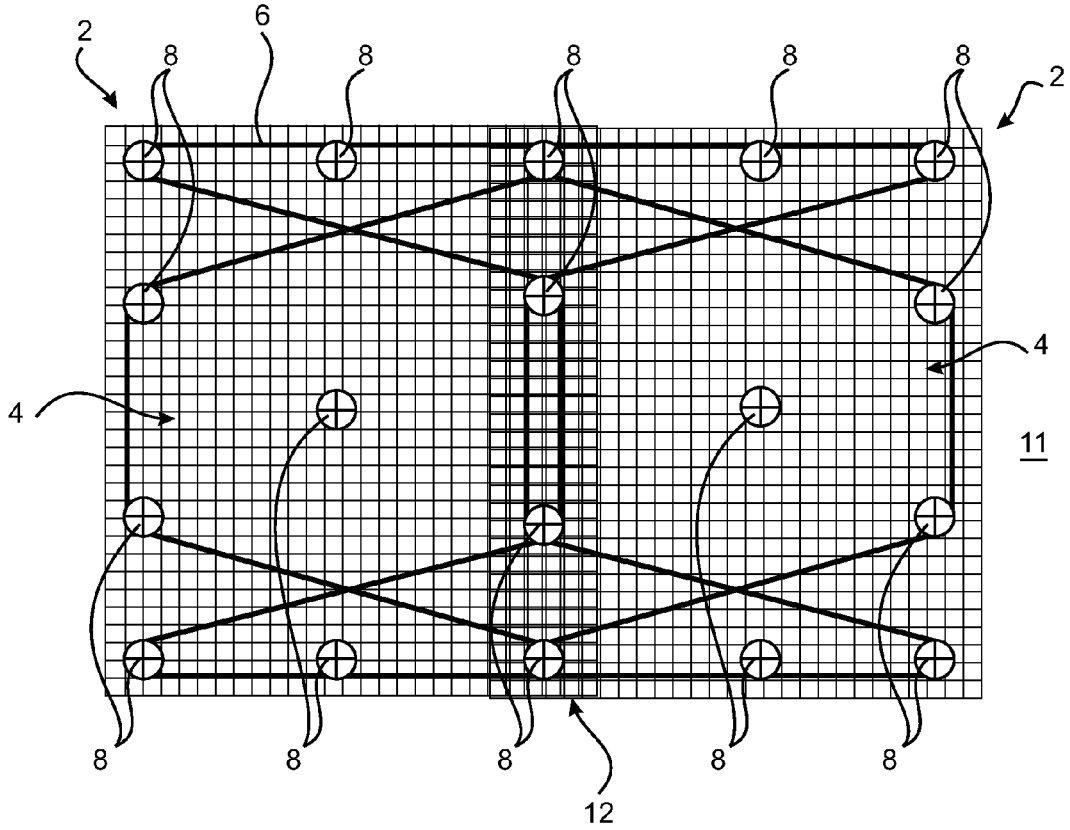
FIG. 3 shows a further configuration of the reinforcing member.
Figure 4:
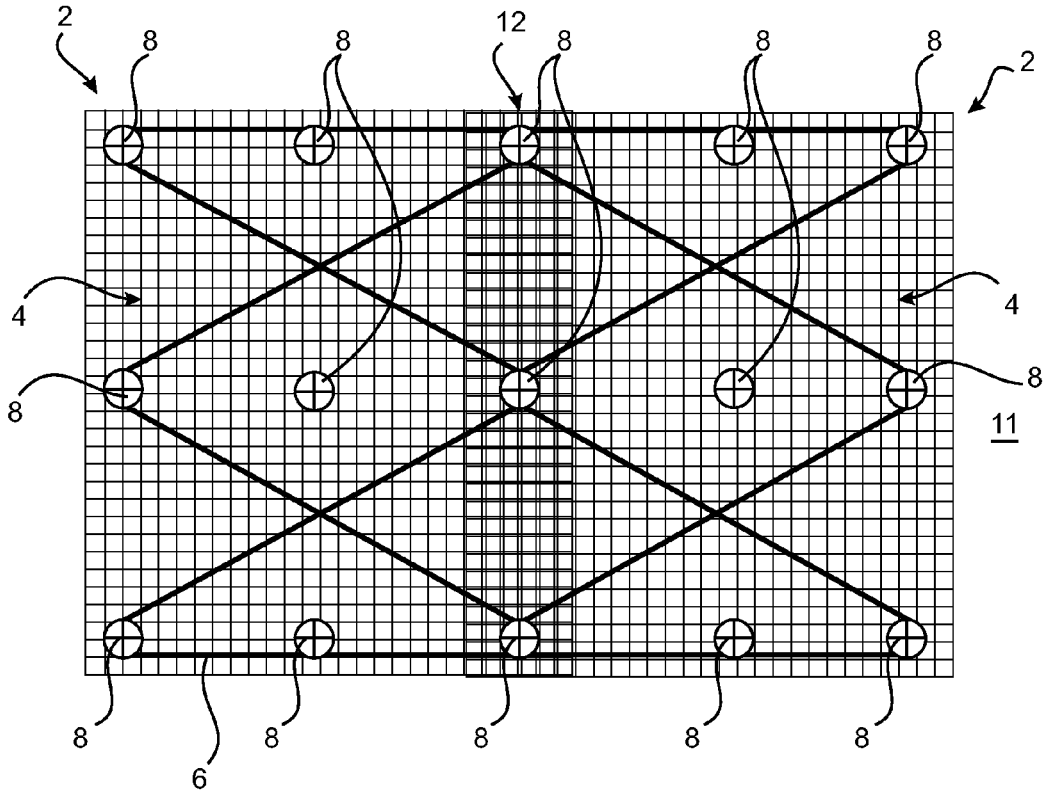
FIG. 4 shows a further configuration of the reinforcing member.

Each of the embodiments of the mesh 2 shown in FIGS. 2 to 4 are, in general, similar, differing only in the configurations of their respective reinforcing members or cables 6. The assembly patterns of reinforcing member 6 may be optimised to maximise reinforcement of the sheet 4, and to keep the overall weight of the system to a minimum. However, as described above, the differences in the configuration of the reinforcing member 6 typically results in a different configuration of fasteners 8 used to install the support meshes 2.

Figure 5:
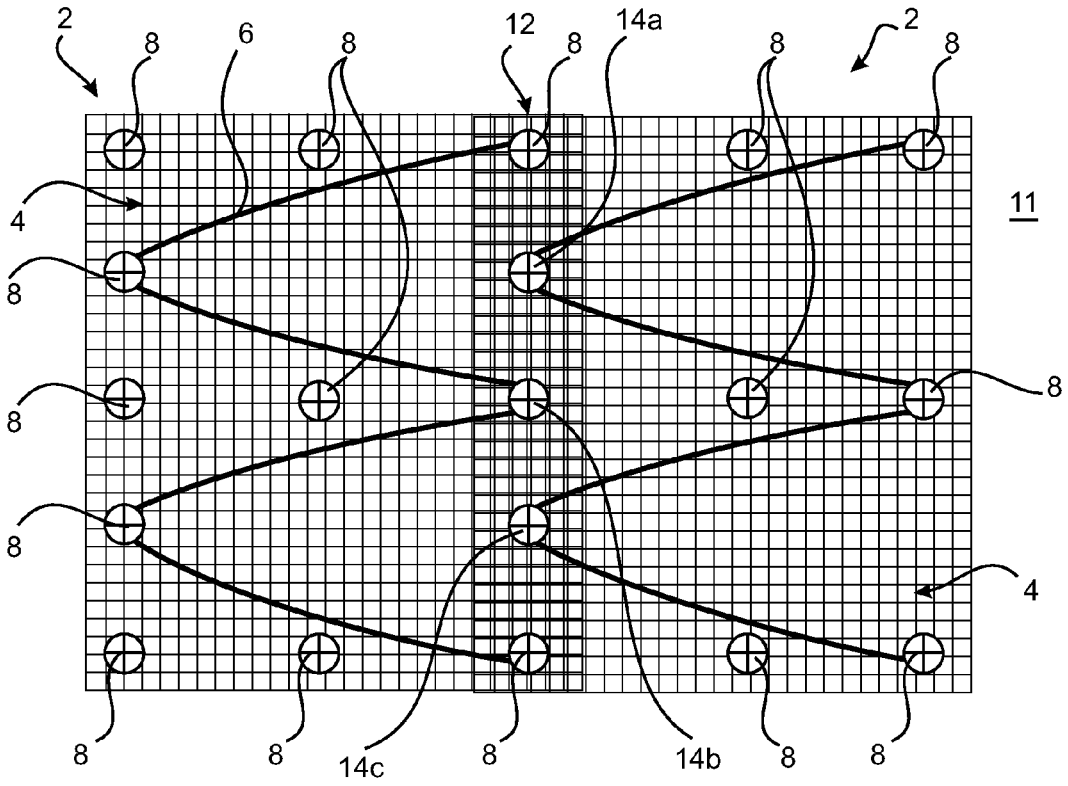
FIG. 5 shows yet a further configuration of the reinforcing member.

FIG. 5 shows an alternative embodiment of the mesh 2 where the cables 6 extend across their respective sheets 4 in a sinusoidal-like configuration. The sheets 4 overlap sufficiently in the overlapping region 12 so that there is an overlap in the cables 6 of the sheets 4, with overlapped portions of the cables being effectively coupled together and clamped by common fasteners 14*a*, 14*b*, and 14*c* to the surface 11. It will be appreciated that this pattern may repeat to extend the area of coverage provided by installed meshes 2.

Figure 6:
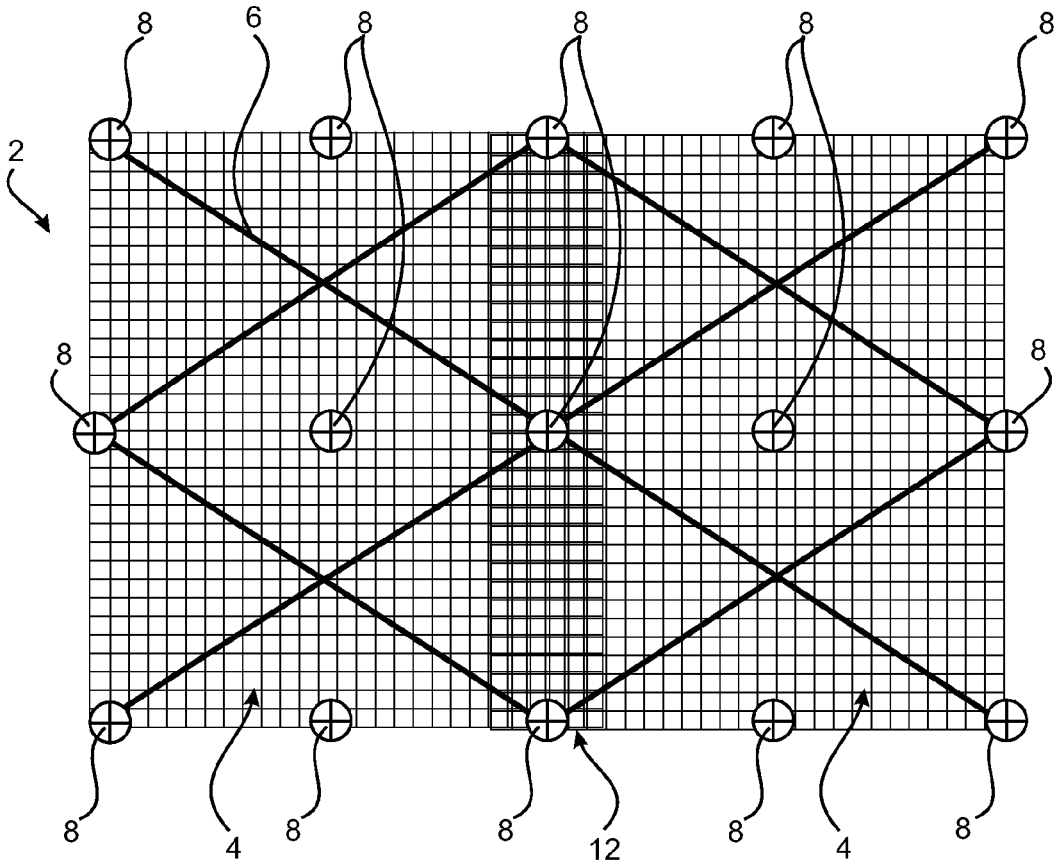
FIG. 6 shows still a further configuration of the reinforcing member.

FIG. 6 shows a further embodiment of the mesh 2 where reinforcing members 6 are configured extending in a diagonal-like relationship extending across each of sheets 4. Similarly, the reinforcing members 6 are clamped by fasteners 8 against the sheets 4 to the surface 11.

Figure 7A:
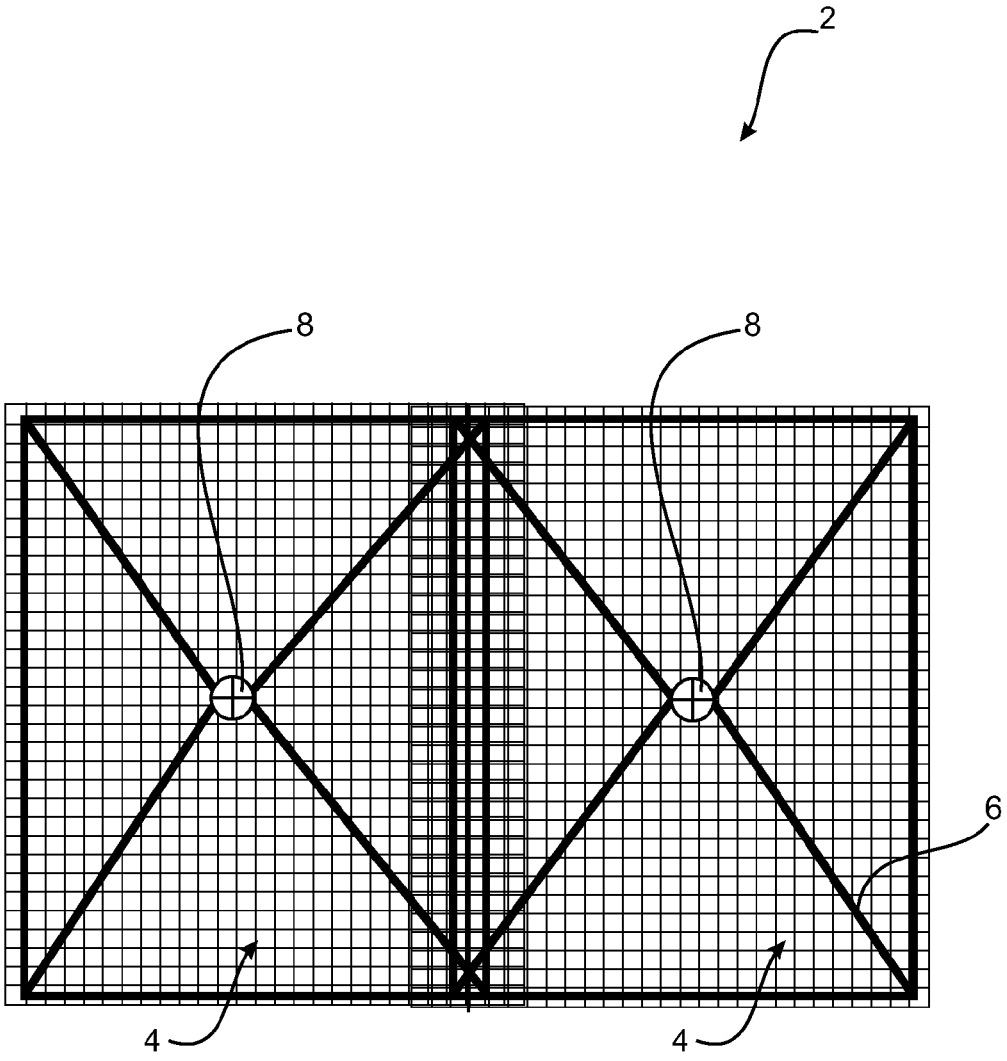
FIG. 7A shows a further configuration of the reinforcing member.
Figure 7B:
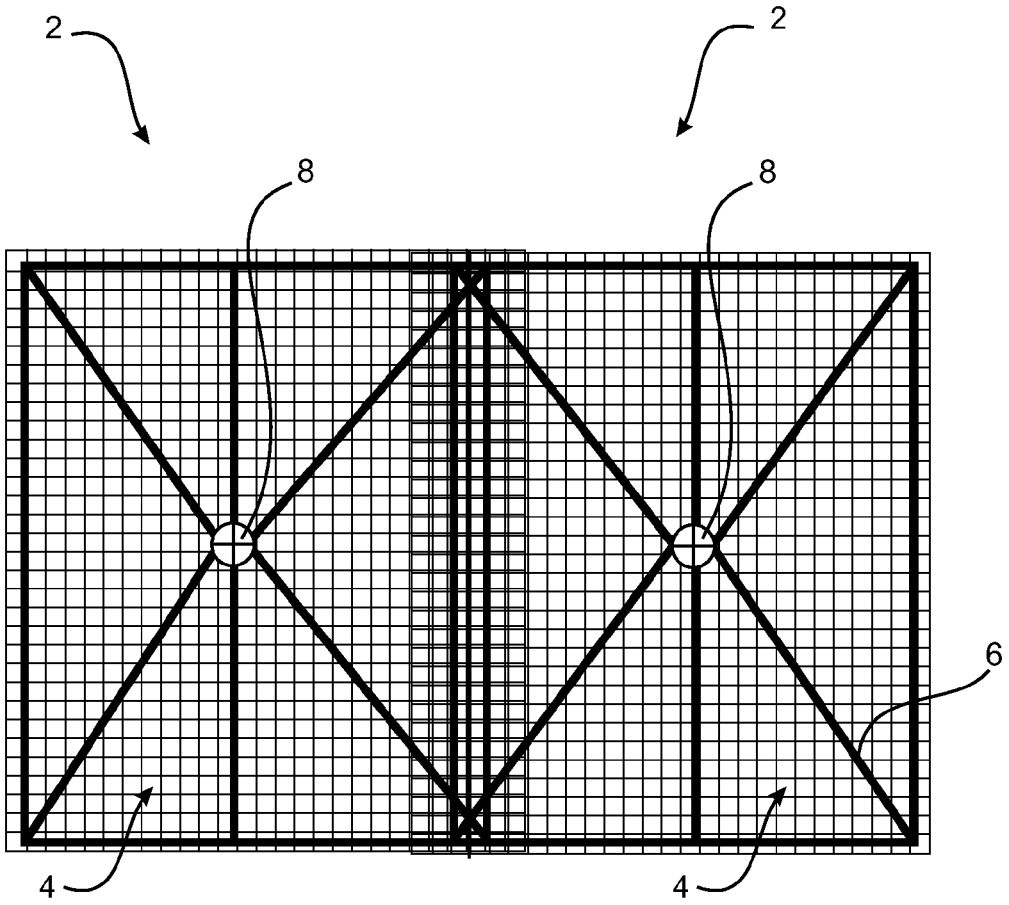
FIG. 7B shows a further configuration of the reinforcing member.

The embodiments of the support mesh 2 shown in FIGS. 7A and 7B show further configurations of how reinforcing member 6 may be used to reinforce the sheets 4. In these embodiments the reinforcing member 6 covers the full perimeter of the individual sheets 4. This results in a well reinforced overlap between sheets 4 having double reinforcing members at this traditionally weak location.

Figure 8A:
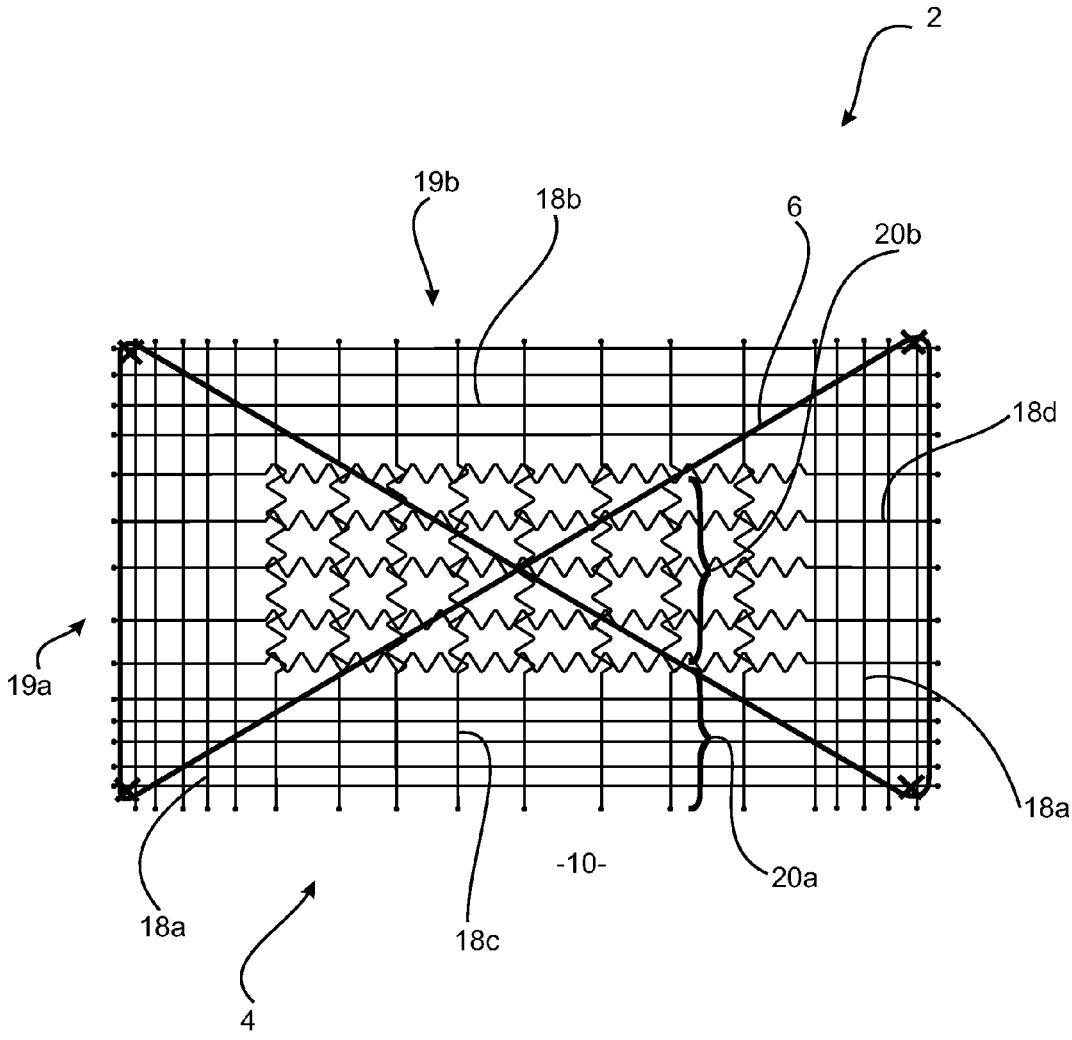
FIG. 8*a* shows a further embodiment of a mesh in accordance with the present invention.

A further embodiment of support mesh 2 is shown in FIGS. 8*a*, 8*b*, 8*c* and 8*d*. FIG. 8*a* shows a sheet 4 comprising a lattice comprising a group of first mesh elements 18*a* and a group of second mesh elements 18*b*. The mesh elements 18*a* and 18*b* may comprise, for example, wires or wire portions. In one embodiment, the group of first mesh elements 18*a* interlace with the group of second mesh elements 18*b* whereby the group of first mesh elements 18*a* extend substantially parallel to a first side 19*a* of the sheet 4, and the group of second mesh elements 18*b* extend substantially parallel to a second side 19*b* of the sheet 4.

In another embodiment of the mesh elements, a sub-group 18*c* of the first elements 18*a* is formed of a length greater than a length of the first side 19*a* of the sheet 4. Similarly, a sub-group 18*d* of the second elements 18*b* is formed of a length greater than a length of the second side 19*b* of the sheet 4. As such, the mesh elements may each comprise, for example with reference to mesh elements 18*c*, straight portions 20*a* and crinkled or bent portions 20*b* which are configured to be outwardly extensible in a direction away and outward from the plane of the mesh sheet 4. Generally, the mesh elements will comprise steel wire of a gauge sufficient for the intended application.

In one embodiment, the crinkled or bent portions of a mesh element are formed so as to be orientated out of a plane within which the mesh sheet resides. In one embodiment, the crinkled or bent portions are formed so as to be orientated within a plane that is substantially orthogonal to the plane within which the mesh sheet resides. Crossing or interlacing wires may be secured to one another at the crossing or interlacing point so as to form an integral lattice mesh structure. Alternatively, the wires may not be secured at their crossing or interlacing points, or may be only secured at specific locations within the lattice arrangement.

Figure 8B:
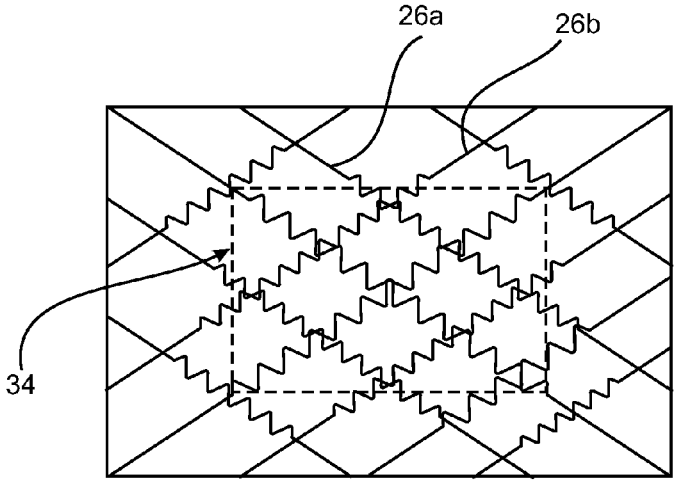
FIG. 8*b* shows a further embodiment of a mesh in accordance with the present invention.
Figure 8C:
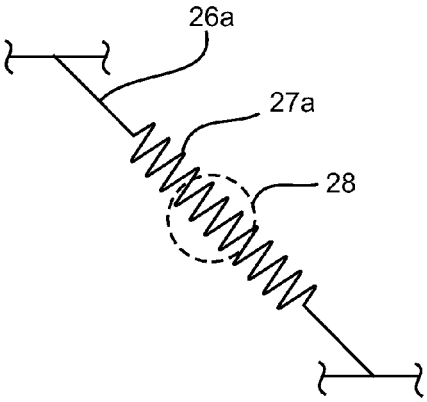
FIG. 8*c* shows one embodiment of a mesh element.
Figure 8D:
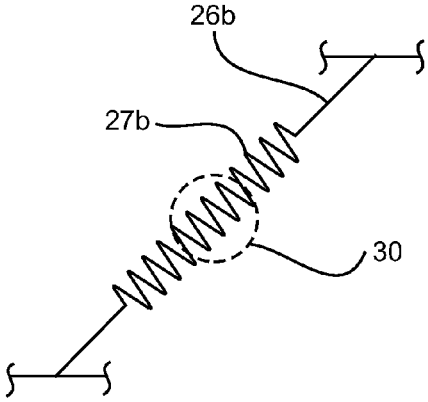
FIG. 8*d* shows a further embodiment of a mesh element.

In another embodiment shown in FIG. 8*b*, the sheet 4 may comprise a group of first mesh elements 26*a* and a group of second mesh elements 26*b* wherein, each of the elements 26*a*, 26*b* may not be aligned with any particular side of sheet 4. The group of first mesh elements 26*a* interlace with the group of second mesh elements 26*b*. With reference now to FIGS. 8*c* and 8*d*, at least one of the first mesh elements 26*a* is formed with a first length 27*a* having one or more crinkles or bends 28 (shown in FIG. 8*c*). Similarly, at least one of the second mesh elements 26*b* may also be formed with a second length 27*b* having one or more crinkles or bends 30 (shown in FIG. 8*c*).

With reference to FIG. 8*b*, a region 34 of the sheet 4 comprises interlaced first 27*a* and second 27*b* lengths of the first 26*a* and second 26*b* mesh elements. With reference to both FIGS. 8*a* and 8*b*, the region 34 of the mesh sheet may be substantially centralised within the sheet 4. Further, the region 34 may extend over substantially the whole of the mesh sheet.

The crinkled or bent portions 28,30 extend or straighten in response to the application of an outward load normal to the surface 11 such as would occur with a rock burst or fall, and thereby absorb at least in part the energy released. This may enhance the structural integrity of the mesh 2 provided by the cables 6. It may be appreciated that any of the configurations of the reinforcing member 6 shown in FIGS. 1 to 7 may be used or applied to the embodiments of the mesh sheets 4 shown in FIGS. 8*a* and/or 8*b*. It will also be appreciated the alternate configurations of bends, turns or other geometrical irregularities may be applied to the portions 28, 30 of the wires 18 to produce similar energy absorbing effects.

A method of installing the mesh system 2 will now be described. Broadly, one possible method comprises an initial step of positioning a support mesh 2 at a location over the surface 11 to be supported, and fastening the mesh 2 to the surface. Fasteners 8 are installed to clamp the cables 6 and the sheet 4 together to the surface 11. This process continues until each of the meshes 2 are secured to the surface 11.

Figure 10:
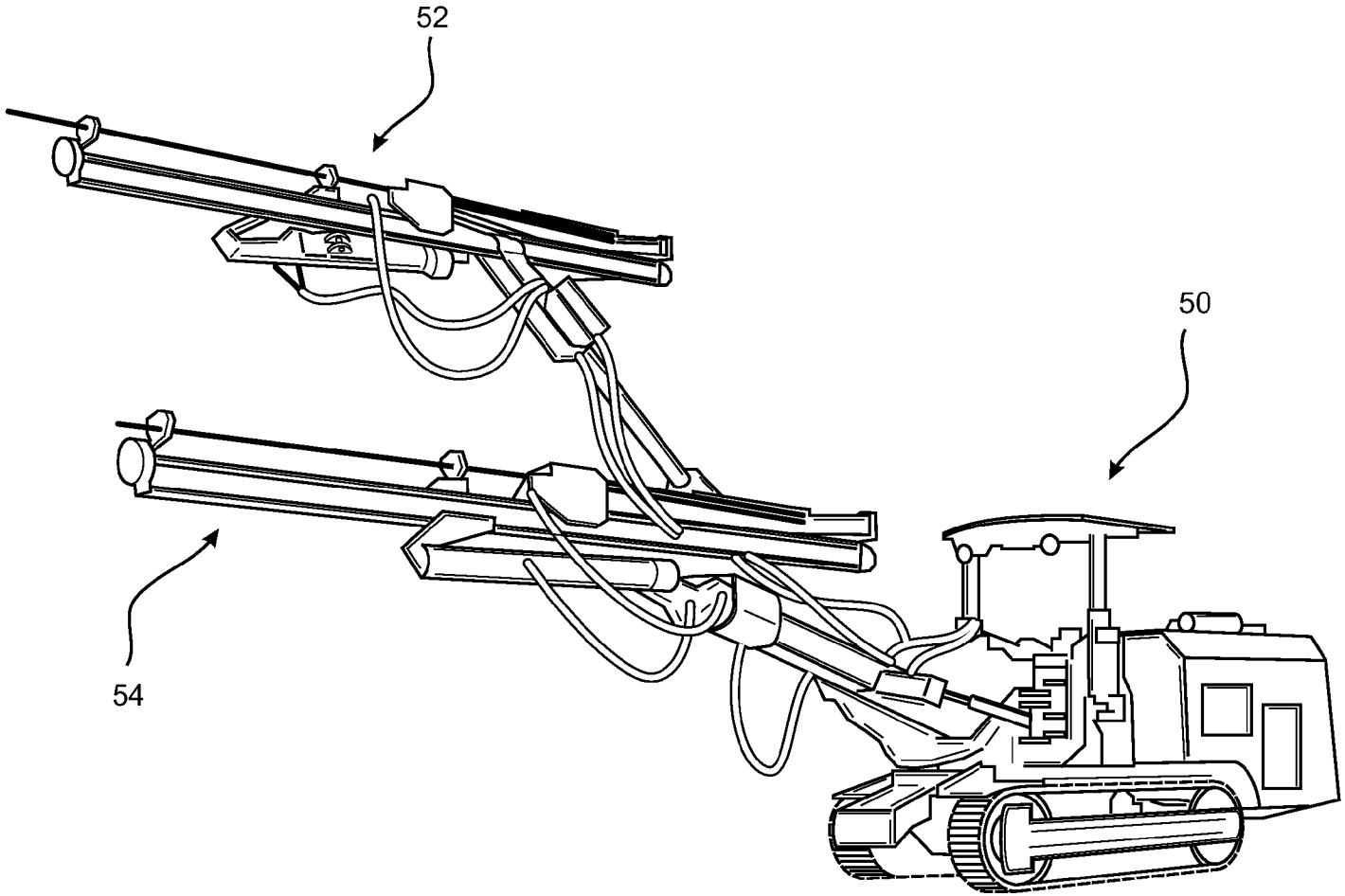
FIG. 10 is a representation of a machine suitable for installing embodiments of the mesh system.

In more detail, an operator may mark (with spray paint or similar marking means) on each sheet 4 the locations at which fasteners 8 will be applied. A drilling machine such as a jumbo 50 depicted in FIG. 10 will normally then be used to lift and position each mesh 2 at the approximate location where the mesh 2 is to be installed. While holding the mesh 2 in one arm 52 of the jumbo 50, an alternate arm 54 drills the holes into which the shafts of the fasteners to pin the mesh 2 will locate. A pinning fastener is then placed into the hole to pin the support mesh 2 in place. The jumbo 50 then pivots or otherwise manoeuvres the mesh 2 into a final position and repeats the drilling process to install another pinning fastener to further pin the mesh 2. The latter may be repeated for as many times as pinning fasteners are required to pin the mesh appropriately (generally, this may require two or three pinning fasteners). With the mesh 2 pinned in the correct position, the jumbo 50 then drills further holes to locate the fasteners 8 to finally clamp and secure the cable 6 and the sheet 4 to the structure 13. In some instances, grout or settable resins may be inserted into the drilled holes. The pinning fasteners used to position and pin the mesh will typically be a smaller less expensive fastener (e.g., a ½ meter split set) than the type used to clamp the cable 6 and the mesh sheet 4 to the surface of the body of material 10.

Each successive mesh 2 may be arranged to overlap adjacent each like meshes 2.

Figure 9:
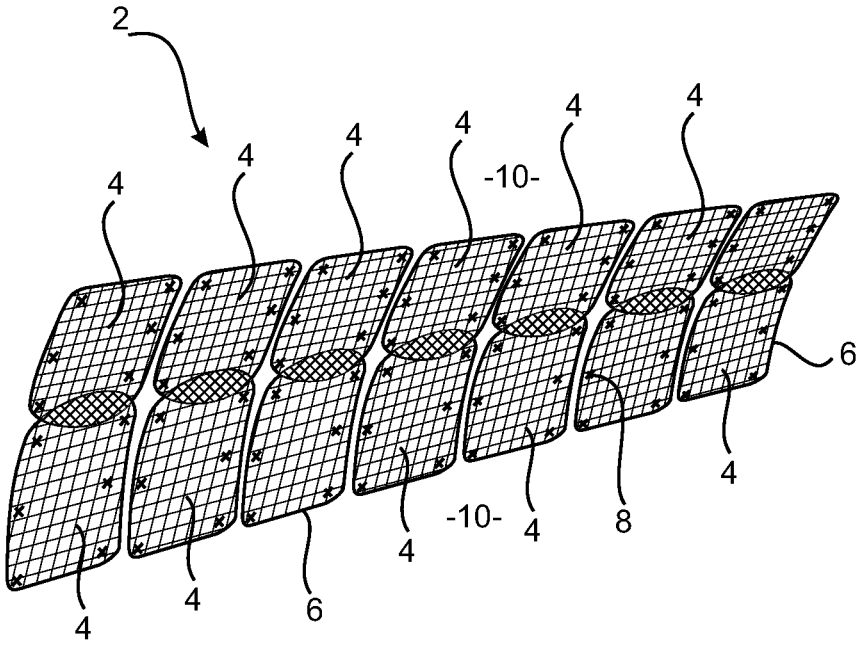
FIG. 9 shows a perspective view of a plurality of support meshes installed according to one embodiment of the present invention.

FIG. 9 shows a perspective view of one embodiment of a plurality of support meshes 2 as applied to a surface of a body of material 10.

Numerous variations and modifications will suggest themselves to persons skilled in the relevant art, in addition to those already described, without departing from the basic inventive concepts. All such variations and modifications are to be considered within the scope of the present invention, the nature of which is to be determined from the foregoing description.

The claims defining the invention are as follows:

1. A mesh system for securing and providing support to a rock surface, the system comprising:

a rectangular mesh sheet in the form of a ground support mesh, the rectangular mesh sheet having four sides forming a peripheral edge of the mesh sheet; and a plurality interconnected mesh elements extending between the sides of the peripheral edge and in a plane of the mesh sheet, the mesh sheet having a matrix of interstices formed by the interconnected mesh elements;

one or more reinforcing cables coupled to and extending across the plane of the mesh sheet wherein the mesh sheet and the one or more reinforcing cables form a pre-assembled unitary panel that is configured to be positioned against the rock surface; and wherein the one or more reinforcing cables include two cable portions that are arranged in a configuration such that a first of the two cable portions extends from a first point near the peripheral edge of the mesh obliquely across the mesh to a second point near the peripheral edge of the mesh, and wherein a second of the two cable portions extends from a third point near the peripheral edge of the mesh obliquely across the mesh to a fourth point near the peripheral edge of the mesh, wherein the first, second, third and fourth points are mutually spaced form each other; and wherein one of the first portion and the second portion crosses over the other of the first portion and the second portion.

2. The mesh system according to claim 1 wherein the plurality of interconnected mesh elements comprise a group of first mesh elements that extend substantially parallel to a first side of the mesh sheet; and a group of second mesh elements that extend substantially parallel to a second side of the mesh sheet.

3. The mesh system according to claim 2 wherein at least a sub-group of the first mesh elements is formed of a length greater than a length of the first side of the mesh sheet.

4. The mesh system according to 3 wherein at least a subgroup of the second mesh elements is formed of a length greater than a length of the second side of the mesh sheet.

5. The mesh system according to claim 4 wherein at least one of the second mesh elements is formed with a second length having one or more bends.

6. The mesh system according to claim 2 wherein at least one of the first mesh elements is formed with a first length having one or more bends.

7. The mesh system according to claim 6 wherein at least one of the second mesh elements is formed with a second length having one or more bends.

8. The mesh system according to claim 1 wherein the one or more reinforcing cables comprise at least one of a multi-wire strand cable; Kevlar® (i.e., poly-paraphenylene terephthalamide); a hybrid of composite and metallic materials.

9. The mesh system according to claim 1 wherein a straight line extending form the first point to the second point is parallel to a further straight line extending from the third point to the fourth point.

10. The mesh system according to claim 9 wherein the first point is near a first corner of the mesh, the second point is near a second corner of the mesh, the third point is near a third corner of the mesh, and the fourth point is near a fourth corner of the mesh, such that the first corner is adjacent to the second corner.

11. The mesh system according to claim 9 wherein the first portion and the second portion are portions of a first of the one or more reinforcing cables.

12. The mesh system according to claim 9 wherein the first portion is a portion of a first of the one or more reinforcing cables and the second portion is a portion of a second of the one or more reinforcing cables.

13. The mesh system according to claim 1 wherein a straight line extending from the first point to the second point intersects a further straight line extending from the third point to the fourth point.

14. The mesh system according to claim 13 wherein the first point is near a first corner of the mesh, the second point is near a second corner of the mesh, the third point is near a third corner of the mesh, and the fourth point is near a fourth corner of the mesh such that the first corner is diagonally opposite the second corner.

15. The mesh system according to claim 13 wherein the first portion and the second portion are portions of a first of the one or more reinforcing cables.

16. The mesh system according to claim 13 wherein the first portion is a portion of a first of the one or more reinforcing cables and the second portion is a portion of a second of the one or more reinforcing cables.

17. The mesh system according to claim 1 wherein the first portion and the seconds portion are portions of a first of the one or more reinforcing cables.

18. The mesh system according to claim 1 wherein the first portion is a portion of a first of the one or more reinforcing cables and the second portion is a portion of a second of the one or more reinforcing cables.

19. A method of supporting a surface of a rock surface, said method comprising the steps of:

positioning a first mesh system comprising:

a rectangular mesh sheet in the form of a ground support mesh, the rectangular mesh sheet having four sides forming a peripheral edge of the mesh sheet; and a plurality interconnected mesh elements extending between the sides of the peripheral edge and in a plane of the mesh sheet, the mesh sheet having a matrix of interstices formed by the interconnected mesh elements;

one or more reinforcing cables coupled to and extending across the plane of the mesh sheet wherein the mesh sheet and the one or more reinforcing cables form a pre-assembled unitary panel that is configured to be positioned against the rock surface; and wherein the one or more reinforcing cables include two cable portions are arranged in a configuration such that a first of the cable portions extends from a first point near the peripheral edge of the mesh obliquely across the mesh to a second point near the peripheral edge of the mesh, and wherein a second of the cable portions extends from a third point near the peripheral edge of the mesh obliquely across the mesh to a fourth point near the peripheral edge of the mesh, wherein the first, second, third and fourth points are mutually spaced form each other; and wherein one of the first portion and the second portion crosses over the other of the first portion and the second portion; and wherein the mesh sheet and the one or more reinforcing cables form a pre-assembled unitary panel, wherein the step of positioning includes lifting the unitary panel with one arm of a jumbo to an approximate location where the first mesh system is to be installed; and securing the first mesh system to the rock surface by one or more fasteners that extend in a direction transverse to the plane of the mesh sheet and engage the one or more reinforcing cables of the first mesh system.

20. The method according to claim 19 further comprising:

marking placing marks on the mesh sheet at positions where said one or more fasteners are to be located.

21. The method according to claim 19, wherein the mesh sheet is a first mesh sheet and the one or more reinforcing cables comprise a first reinforcing cable, the method comprising:

positioning a second mesh system identical to the first mesh system with one arm of the jumbo in a manner where the mesh sheet of the second mesh system partially overlaps with the mesh sheet of the first mesh system; and securing the second mesh system to the rock surface by one or more fasteners that extend into the rock surface in a direction transverse to the plane of the mesh sheet of the second mesh system.

22. The method according to claim 21 wherein said securing comprises fastening the reinforcing cable of the second mesh system to the rock face at a location where the reinforcing cable of the second mesh system overlies the mesh sheet of the first mesh system.

23. The method according to claim 22 wherein the securing comprises fastening the one or more reinforcing cables of the first and second mesh systems to the rock face with at least one common fastener.

24. The method according to claim 19 wherein the securing comprises operating a second arm of the jumbo to pin the mesh sheet to the rock face and subsequently operating the jumbo to apply the one or more fasteners to fasten the one or more reinforcing cables of the first mesh system to the rock face.

25. The method according to claim 19 wherein the securing comprises fastening each reinforcing cable of the mesh system to the rock face.

* * * * *